United States Patent [19]

Trainor

[11] Patent Number: 4,638,411

[45] Date of Patent: Jan. 20, 1987

[54] MODULAR HIGH-INTENSITY ELEVATED RUNWAY EDGE OR THRESHOLD LIGHT

[75] Inventor: Willis H. Trainor, Newark, Ohio

[73] Assignee: ADB-Alnaco, Inc., Columbus, Ohio

[21] Appl. No.: 784,069

[22] Filed: Oct. 4, 1985

[51] Int. Cl.[4] ..... F21S 1/14

[52] U.S. Cl. ..... 362/145; 362/267; 362/363; 362/374; 362/337

[58] Field of Search ..... 362/362, 363, 374, 375, 362/145, 267, 337

[56] References Cited

U.S. PATENT DOCUMENTS

| | | | |
|---|---|---|---|
| 1,695,258 | 12/1928 | Spear | 362/336 |
| 2,375,311 | 5/1945 | Meyers | 362/337 |
| 2,395,756 | 2/1946 | Parsons | 362/145 |
| 4,180,850 | 12/1979 | Bivens | 362/145 |
| 4,393,440 | 7/1983 | Yperman | 362/145 |
| 4,521,836 | 6/1985 | Puttemanns et al. | 362/145 |

*Primary Examiner*—E. Rollins Cross

*Attorney, Agent, or Firm*—John L. Gray

[57] ABSTRACT

A modular high-intensity elevated runway edge or threshold light having a glass outer dome containing two oppositely disposed prisms therein, sealed to said cover and fixedly positioned with respect to two complementary inner prisms surrounding a light source. The entire assemblage may be easily removed by loosening two wing nuts for bulb replacement and, if necessary, the inner prisms may be readily replaced by removing three screws and when reinserted will be in exact alignment with the outer prisms.

3 Claims, 3 Drawing Figures

MODULAR HIGH-INTENSITY ELEVATED RUNWAY EDGE OR THRESHOLD LIGHT

BACKGROUND OF THE INVENTION

Navagational lights used in airports in the United States must conform to certain minimum standards set by the Federal Aviation Administration. Comparable standards exist in other countries proscribed by the appropriate agency having jurisdiction over airports in that particular country. In the United States FAA Advisory Circular AC 150/5435-46 sets forth the specifications for elevated runway edge lights identified as FAA L-862 and elevated runway threshold lights identified as FAA L-862E.

In each instance the light, while providing lighting through a full 360° area, contains two oppositely disposed areas of high intensity light, 180° apart, thus enabling pilots to identify the threshold and edges of the runway more readily.

These areas of high intensity are created by the use of an inner and an outer optical prism. The outer prism is usually a single hemispherical-shaped, vertically elongated, transparent glass dome, thus providing weatherproofing for the lamp inside. Inside this prism is located a second prism, usually in two parts, which surrounds the light bulb.

The inner prism may be transparent or may be colored. For example, in some cases one half of the inner prism will be green and the other half will be red, or some other color combination.

The inner prism tends to compress the light rays passing through it in a vertical direction, whereas the portion of the outer prism through which the same light rays pass are compressed in a horizontal direction, thus resulting in a single beam of bright light emanating from either side of the light.

It is essential that these prisms be precisely aligned so that the optimum optical results are achieved. During normal operation it is necessary to change the high-intensity quartz light bulb from time to time in the field and this requires the removal of the outer prism, separation and removal of the two inner prisms, and any metal bands or other units that are used to hold the assemblage in place, in order to reach the light bulb.

In prior art devices, as many as six separate operations must be performed before the light source can be replaced.

Not only is this inconvenient for the maintenance worker, especially in adverse weather conditions such as snow and rain, but can result in the loss of components, such as in the snow, and in the case of colored inner prisms, sometimes can result in reverse assemblage of the units, which is not observed until the lights are again turned on at night time.

SUMMARY OF THE INVENTION

The present invention overcomes the disadvantages above described of the prior art by providing an outer glass dome prism which is perfectly aligned with the inner split prism and is sealed into the cover which overhangs the base of the light with an elastic sealant compound, thus providing an absolute seal against moisture or water entering the interior of the light and also assuring that the outer prism and the inner prism are properly aligned. The outer and inner prism may be removed as a unit by simply loosening two thumb screws in order to replace a defective light bulb. However, if it is desirable to change the inner prisms for any reason, this can be accomplished very readily and when replaced, will be in perfect alignment with the outer prism.

This invention also incorporates a ball joint in the base of the light where it is attached to the upstanding conduit containing the underground electrical cable so that accurate elevation and azimuth positioning may be achieved and then the entire assembly is secured by three screws.

It is therefore an object of this invention to provide a modular high intensity, elevated runway edge or threshold light in which the light bulb may be replaced in the field with a minimum of operation on the part of maintenance personnel.

It is a further object of this invention to provide such a light which effectively is sealed against rain, snow, sleet, dust or other unfavorable weather conditions.

It is a still further object of this invention to provide such a light wherein the inner and outer prisms are always in precise alignment, even if the inner prisms are replaced.

These together with other objectives and advantages of the invention should become apparent in the details of construction and operation as more fully described herein and claimed, reference being had to the accompanying drawings forming a part hereof where like numerals refer to like parts throughout.

DETAILED DESCRIPTION OF THE DRAWINGS

Figure 1:
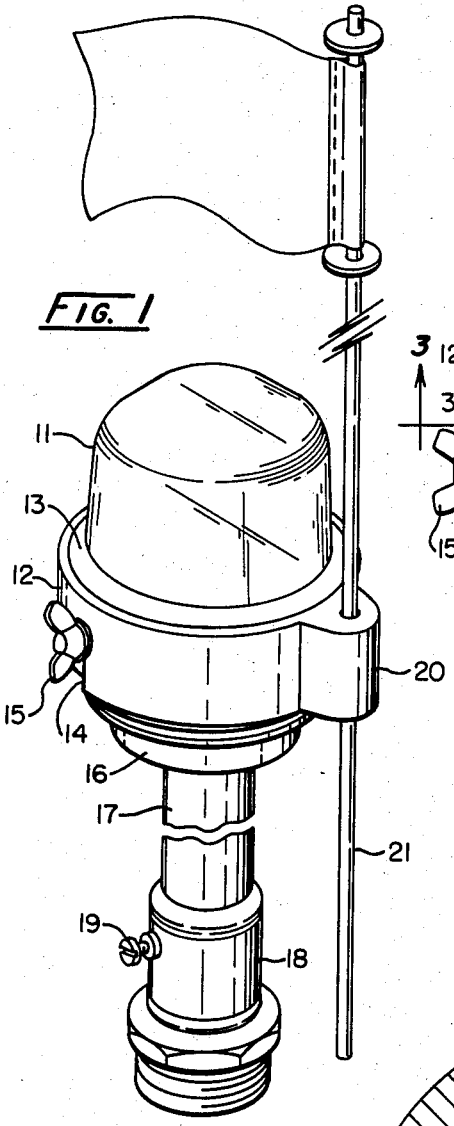
FIG. 1 is a perspective view of the modular high-intensity elevated runway edge or threshold light of the instant invention.

Referring now more particularly to FIG. 1, the glass light is shown at 11 molded into and sealed in cover 12 by means of an elastic sealant compound 13. The cover 12 is provided with oppositely disposed slots 14—14 which fit over wing nuts 15—15 which are threaded into base 16. Base 16 is supported on electrical conduit 17 positioned in a conventional vertical support 18 and held against movement by means of the screw 19. Cover 12 is provided with an integral extension 20 which is adapted to hold the snow flag 21.

Figure 2:
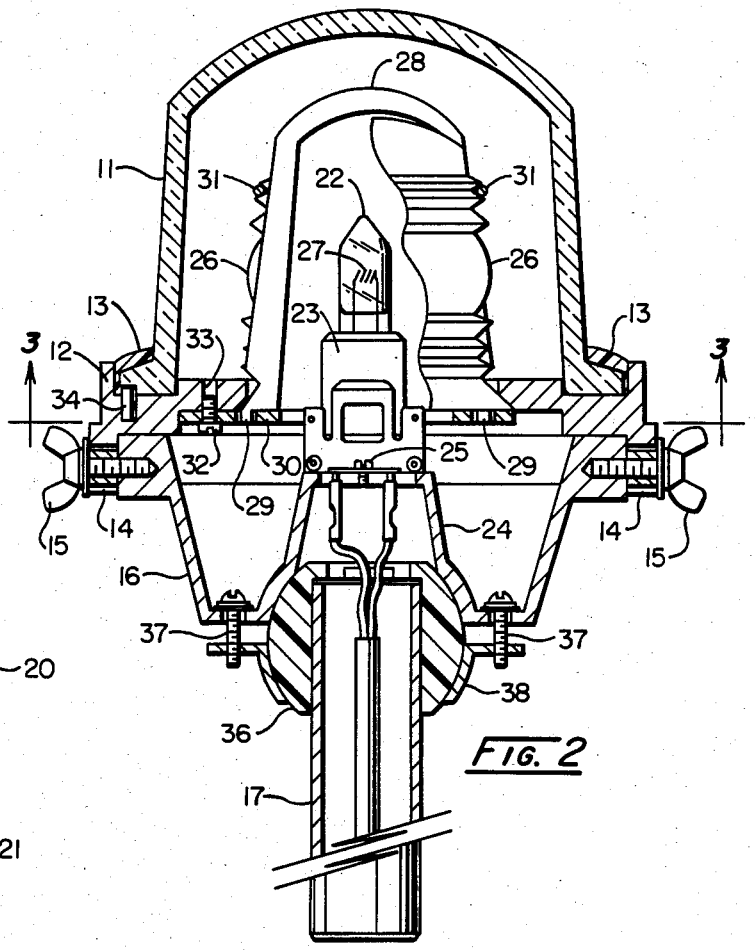
FIG. 2 is a side elevation primarily sectional view of the instant invention.
Figure 3:
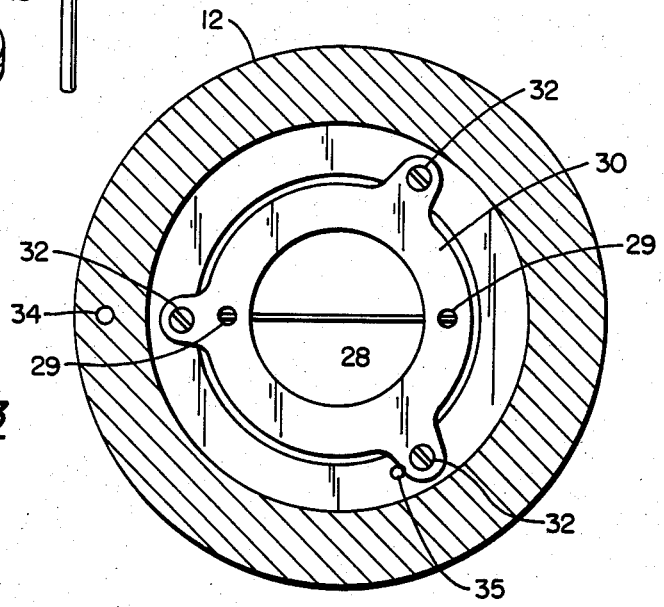
FIG. 3 is a plan sectional view of the instant invention on section line 3—3 of FIG. 2.

Referring now more particularly to FIG. 2, it will be seen that the incandescent light bulb 22 is located in socket 23, which is fixedly secured to the upstanding portion 24 of base 16 by means of screws 25—25. It is important that the light bulb be accurately positioned with respect to the outer prism 11 and the two portions 26—26 of the inner prism so that the filament 27 of the light bulb 22 is perfectly aligned with those portions of the inner and outer prism so as to enable the oppositely disposed intense light beams to be created. The two inner prism sections 26—26 are separated by means of a metal U-shaped member 28, which is positioned in holes 29—29 of base member 30. The assemblage of the inner prisms 26—26 and separating ring 28 are held together by means of spring retainer ring 31. Base 30 is secured to cover 12 by means of screws 32—32 in threaded openings 33—33 in cover 12. In manufacturing assembly, glass light dome 11 is precisely positioned on cover 12 by means of pin 34, which is located in cover 12 and light dome 11 has a corresponding opening relative to the position of the prism in light dome 11. Thus light dome 11, during manufacturing assembly, will be precisely located with respect to cover 12. Likewise, the inner prisms 26—26 are precisely located with respect to cover 12 and thus with respect to light dome 11 by means of the threaded openings 33—33 in cover 12 and the screws 32—32. This alignment is provided in the field by means of locating pin 35 as shown in FIG. 3, which adjoins a complementary groove in base 30. The base portion 16 of the light is positioned on ball joint 36 by means of screws 37—37, which are screwed into complementary circular member 38, as well as base member 16.

In installing this light in the field, the proper length of conduit 17 is chosen in order to position the lights in the same horizontal plane and the conduit 17 is secured in the holder 18 by means of screw 19. By loosening screws 37—37, the elevation and azimuth of the base 16 may be adjusted quickly and easily by virtue of the 360° of freedom in the horizontal plane provided by the ball joint 36 and the screws 37—37 are tightened to hold the base 16 in that position and to seal the underside of the base from the entrance of moisture and dust. The cover 12 is merely placed on the base 16 so that the slots 14—14 fit over the wing nuts 15—15 and then the wing nuts are tightened.

In order to change a light bulb, it is simply necessary to loosen wing nuts 15—15, remove the cover 12 to which are attached the glass light dome 11, the base 30 and the inner prisms 26—26, leaving the light bulb 22 readily accessible for removal and replacement.

In the event that it is necessary to change the inner prisms, it is a simple matter merely to remove screws 32—32 and the assembly of base 30 and the inner prisms 26—26 may be readily removed from cover 12. Removing spring retainer ring 31, which is a snap ring, enables the two prisms to be removed and readily replaced. Upon reassembly, pin 35 will only fit its complementary groove in base 30 so that it is not possible to have the base turned 120° out of position.

While this invention has been described in its preferred embodiment, it is appreciated that variations thereon may be made without departing from the true scope and spirit of the invention.

What is claimed is:

1. An elevated modular high-intensity runway edge or threshold light comprising:

a substantially hollow base having a bottom wall, a ball joint centrally positioned in the bottom wall of said base and adapted to receive an upstanding conduit, said ball joint comprising an adjustable securing means for fixedly positioning said base and said ball joint onto said upstanding conduit, means supported centrally on said base adapted to receive a light source and fixedly positioned with respect to said base, a cover comprising a lower annular portion and a hollow glass dome, including oppositely disposed prism portions adapted to compress the light emanating from said light source in one plane, said glass dome being sealed in said lower annular portion and fixedly positioned with respect thereto, said lower annular portion having an inner base portion resting on the upper portion of said hollow base, a hollow circular support removably secured to the lower portion of said inner base portion of said cover and supporting two hollow prisms adapted to surround said light source and being fixedly positioned in relation to the prisms in said hollow glass dome, said two hollow prisms being adapted to compress the light emanating from said light source in a plane perpendicular to the plane in which the light from said light source is compressed by the prism portions of said hollow glass dome before said light passes through the prism portions of said hollow glass dome, whereby said two hollow prisms and said prisms in said hollow glass dome are fixedly positioned in relation to each other and in combination provide two oppositely disposed areas of high-intensity light, and said entire assemblage may be readily removed for maintenance.

2. The light of claim 1 wherein said two hollow prisms surrounding said light source are held in position by means of a separating metal strap and a retainer ring.

3. The light of claim 1 wherein said hollow circular support is attached to the lower portion of said inner base portion by means of three screws and is located in spatial relation to said inner base portion of said cover by means of an indexing pin.

* * * * *